US005131331A

United States Patent [19]

Lynch, Jr. et al.

[11] Patent Number: 5,131,331

[45] Date of Patent: * Jul. 21, 1992

[54] ARTICULATED COUPLING APPARATUS FOR CONNECTING ADJACENT ENDS OF A PAIR OF RAILWAY CARS

[75] Inventors: Edward G. Lynch, Jr., Saugus, Calif.; David W. Daugherty, Jr., Bolingbrook; Wajih Kanjo, Lockport, both of Ill.; Michael G. Hawryszkow, Munster, Ind.; William D. Wallace, Chicago, Ill.

[73] Assignees: Westinghouse Air Brake Co., Wilmerding, Pa.; Sargent Industries, Inc., Waukesha, Wis.

[ * ] Notice: The portion of the term of this patent subsequent to Nov. 19, 2008 has been disclaimed.

[21] Appl. No.: 520,686

[22] Filed: May 8, 1990

[51] Int. Cl.[5] ..... B61D 15/00

[52] U.S. Cl. ..... 105/3; 213/75 R; 213/74

[58] Field of Search ..... 105/3, 4.1, 1.4, 4.2, 105/4.3; 213/10, 12, 14, 18, 74, 75 R, 77, 98, 188, 62 R; 280/492, 511; 180/235, 134; 403/154, 155, 316, 324

[56] References Cited

U.S. PATENT DOCUMENTS

| | | | |
|---|---|---|---|
| 999,892 | 8/1911 | Schultz | 403/154 |
| 2,013,546 | 9/1935 | Wallace | 105/3 |
| 3,646,604 | 2/1972 | Tack et al. | 105/4.3 |
| 3,716,146 | 2/1973 | Altherr | 105/4.3 |
| 4,258,628 | 3/1981 | Altherr | 105/4 R |
| 4,491,436 | 1/1985 | Easton | 403/154 |
| 4,593,829 | 6/1986 | Altherr | 213/75 R |
| 4,597,499 | 7/1986 | Hanula | 403/154 |
| 4,867,071 | 9/1989 | Weber | 105/4.1 |

OTHER PUBLICATIONS

Maintenance Manual for ASF Articulated Connection Assembly, American Steel Foundries (no date).

*Primary Examiner*—Robert J. Oberleitner
*Assistant Examiner*—Mark T. Le
*Attorney, Agent, or Firm*—J. O. Ray, Jr.

[57] ABSTRACT

The present invention provides an articulated coupling apparatus which connects one end of one railway car to an adjacent end of a second railway car in a semipermanent manner. Such coupling apparatus includes a male connection member, a female connection member, a bearing assembly, and a device for securing such bearing assembly to the coupling apparatus.

46 Claims, 3 Drawing Sheets

ARTICULATED COUPLING APPARATUS FOR CONNECTING ADJACENT ENDS OF A PAIR OF RAILWAY CARS

FIELD OF THE INVENTION

The present invention relates, in general, to railway car coupling equipment and, more particularly, this invention relates to an articulated-type coupling apparatus which connects one end of a first railway car to an adjacent predetermined end of a second railway car, in a semipermanent manner, and which enables all standard size railway cars presently in use by the railway industry to negotiate all known curves in presently used track structures.

BACKGROUND OF THE INVENTION

Prior to the present invention, in the railroad industry it is well known to use standard couplers which were approved by the Association of American Railroads (AAR). These couplers are used to connect adjacent ends of a pair of railway cars together. For example, in this application, such couplers were generally designed to facilitate both the connecting and disconnecting of individual railway cars. These couplers enable such cars to be readily combined to make up a train consist, or to be individually separated for loading and unloading purposes as necessary.

In more recent times, however, the railroad industry has discovered that the interconnecting of several railway cars together to form a generally semipermanent unit has a number of distinct advantages. For example, these advantages are gained when such railroad cars are adapted for use in "piggyback" service and have been joined together in this manner. The railroad cars which are joined in such semipermanent fashion are commonly referred to in the railroad industry as a "10-pack". These 10-pack units do not require the use of the standard coupler discussed above, except between units. In other words, on the ends of such 10-pack units. The reason such standard couplers are not required is because these units are only broken periodically. Normally, this occurs when maintenance or replacement of an individual component must be carried out. Obviously, considerable cost-savings can be achieved by this arrangement. These cost-savings are derived from lower weight, fewer railway trucks, reduced maintenance, and lower equipment cost. Such lower weight and reduced equipment cost being achieved, in part, by eliminating the need for draft gears and the number of trucks required.

With the use of these semipermanent coupling arrangements and with the higher loads being carried by modern railway trains, it is of the utmost importance that a close-buttoned relationship be maintained between the coupler draft components during service. Such close-buttoned relationship is required to reduce the effects of the impact forces which are encountered under buff conditions of train operations.

the prior type of articulated coupling devices, used for the purpose of connecting adjacent ends of a pair of railway cars in a semipermanent manner, is taught in U.S. Pat. No. 4,258,628. This particular articulated coupling device includes a male connection member secured to one end of a first railway car body, and a female connection member secured to an adjacent end of a second railway car body. The female connection member, in this arrangement, is rotatably-engaged in a center plate bowl of a bolster of a railroad car truck in a manner that is well known in the railway art. The outer end of the male connection member is disposed for movement in a cavity that is formed in the outer end of such female connection member. Both the male and female connection members are joined, in a semipermanent manner, by a pin member. This pin member is positioned in a vertical direction and disposed in aligned apertures formed in each of the male and female connection members. The aperture formed in the male connection member for receiving the pin member must be somewhat larger than the pin member itself to allow certain required movements. A rear surface portion of the aperture formed in the male connection member for receiving the pin member has a horizontal concave configuration and a vertical convex configuration. This configuration enables both the male connection member and the female connection member to move in each of a horizontal direction and a vertical direction in relationship to one another while, at the same time, providing a relatively substantial area of surface contact between the rear surface of the pin aperture and the pin member.

The outer end surface of the outer end of the male connection member includes a convex configuration which abuts against a complimentary concave surface formed on a front face of a follower member. In this coupling device, the follower member is carried within the rear portion of the cavity formed in the other end portion of the female connection member. A pair of vertically-disposed, slot-like cavities are formed on the rear face of such follower member. Each of these vertical slots has a resilient element disposed therein which protrudes outwardly from such follower member. The exposed outer surface of each such resilient element is engaged by a vertically-disposed wedge element. Such wedge element is provided to urge the follower member and the male connection member forward. In this manner, the rear surface portion of the aperture formed in the male connection member is maintained substantially in contact with the pin member at all times.

Such contact is necessary in these prior art articulated coupling devices, because most of the articulated connecting parts are cast members. In order to reduce the cost of this coupling device, the cast members receive very little, if any, finish-machining to provide the necessary or desired dimensional control. As a result of this, it is rather difficult to provide an articulated coupling device which is self-adjusting under various wear conditions to minimize the slack in the various connections encountered during service. Other prior art articulated coupling devices are taught in U.S. Pat. No. 3,716,146 and Canadian Pat. No. 1,231,078.

SUMMARY OF THE INVENTION

The present invention provides an improved articulable coupling apparatus. Such coupling apparatus being used for connecting, in a substantially semipermanent manner, at least one end of a first railway car to an adjacent end of a second railway car. Such articulable coupling apparatus is capable of retrofitting on existing cars. In a presently preferred arrangement of the invention, such articulable coupling apparatus includes a male connection member. A first end of such male connection member is adapted to be engaged with and secured to a center sill member adjacent one predetermined end of one of such first railway car and such second railway car. Such center sill member being disposed substantially along a longitudinal centerline of one of such first railway car and such second railway car. A predetermined portion of an elongated second end of the male connection member includes an aperture, having a predetermined size and a predetermined shape, formed therethrough. A longitudinal axis of such aperture lies in a substantially horizontal plane and is disposed transverse to the longitudinal axis of the male connection member. Such aperture includes at least one ledge portion. The outer end surface of the second end of such male connection member includes a convex configuration in both a horizontal plane and a vertical plane. A female connection member is provided which, at a first end thereof, is adapted to be engaged with and secured to a center sill member disposed substantially along a longitudinal centerline and which terminates on an adjacent predetermined end of an opposite one of such first railway car and such second railway car. The second end of this female connection member includes a substantially open top cavity formed therein. Such open top cavity receives at least a portion of the second end of the male connection member therein. In this manner, the second end of the female connection member is provided with a horizontally-disposed bottom wall, a substantially vertically-disposed back wall connected along a bottom edge thereof to a rear edge of such bottom wall, an arcuately-shaped portion engageable with a predetermined portion of each of such bottom wall and such back wall, and a pair of substantially parallel upstanding side walls. The bottom wall carries a center plate member. Such center plate member is positionable for rotation within the bolster center bowl of a railway truck. Each of such pair of upstanding side walls has an axially-opposed, cutout portion formed therein. Each cutout portion includes both a generally rectangular slot-like portion adjacent a front surface and a generally spherical portion behind such slot-like portion. The articulable coupling apparatus further includes a bearing assembly, at least a portion of which is engageable in such aperture formed in the second end of the male connection member and the spherical portion in each of the upstanding side walls cutout portion formed in the second end of the female connection member. Such spherical member includes a longitudinal bore formed therethrough. This bore has a predetermined size and a predetermined shape. The bearing assembly also includes a pin member disposed in such bore and extending outwardly a predetermined length on each side of such spherical member. A pin member, having a horizontally-disposed longitudinal axis, is provided and extends through such bore in the spherical member for a predetermined length on each side of axially-opposed surfaces of such spherical member. A portion of this pin member, disposed within the bore of such spherical member, has a substantially identical size and a substantially identical shape as the predetermined size and predetermined shape of the bore. At least a portion of such predetermined length on each side of the spherical member engages at least a portion of such opening formed through the pair of side wall portions and has a substantially identical size and identical configuration as a predetermined portion of such predetermined configuration of the opening. A race assembly having a substantially spherical inner surface is positioned positioned within such aperture to enable movement of the male connection member in relation to the female connection member in both a vertical direction and a horizontal direction over a predetermined range. Such race assembly having an outer surface which is substantially identical in size and shape as such predetermined size and predetermined shape of the aperture formed through the predetermined portion of such second end of the male connection member. A first securing means engageable with each of said race assembly and such second end of the male connection member adjacent such aperture formed through such predetermined portion thereof is provided to secure such race assembly and such spherical member to the second end of the male connection member. A second bore is formed through at least one of such vertically-disposed side walls adjacent a front edge thereof and above the slot-like portion of such opening formed through such side wall. Such second bore having a substantially vertical axis. A third bore is formed through such at least one of such vertically-disposed side walls adjacent such front edge thereof and below the slot-like portion of the opening formed through such side wall. Such third bore having a substantially vertical axis which is in axial alignment with the vertical axis of the second bore. A second securing means is engageable with a portion of at least one of such predetermined length of such pin member on each side of such axially-opposed surfaces of the spherical member and each of such second bore and such third bore formed in such at least one vertically-disposed side wall for securing the bearing assembly to the second end of the female connection member and thereby securing the male connection member to the female connection member to form the articulable-type coupling apparatus of the present invention.

OBJECTS OF THE INVENTION

It is, therefore, one of the primary objects of the present invention to provide an articulable coupling apparatus for connecting adjacent predetermined ends of a pair of railway cars together, in a semipermanent manner, which apparatus requires fewer components.

Another object of the present invention is to provide an articulable coupling apparatus for connecting adjacent predetermined ends of a pair of railway cars together, in a semipermanent manner, in which a minimum number of components must move relative to one another during operation of such railway cars.

Still another object of the present invention is to provide an articulable coupling apparatus for connecting, in a semipermanent manner, the adjacent ends of a pair of railway cars together which is relatively simple to assembly and disassemble.

A further object of the present invention is to provide an articulable coupling apparatus for connecting, in a semipermanent manner, the adjacent ends of a pair of railway cars together, which can be adapted to any of the presently approved lengths for such railway cars, and which can operate on all of the various curves in the track structures which are in use at the present time.

An additional object of the present invention is to provide an articulable coupling apparatus for connecting adjacent ends of a pair of railway cars together, in a semipermanent manner, which can be more easily maintained in proper working order.

Yet another object of the present invention is to provide an articulable coupling apparatus for connecting adjacent predetermined ends of a pair of railway cars together, in a semipermanent manner, which requires a minimum amount of machining of the finished components prior to final assembly.

Another object of the present invention is to provide an articulable coupling apparatus for connecting, in a semipermanent manner, the adjacent ends of a pair of railway cars together, which generally will be lighter in weight than presently used articulated coupling devices.

Still yet another object of the present invention is to provide an articulable coupling apparatus for connecting adjacent ends of a pair of railway cars together, in a semipermanent manner, which will generally be more cost-effective for the railroad industry.

In addition to the above-described objects and advantages of the articulable coupling apparatus, constructed according to this invention, various other objects and advantages of the present invention will become more readily apparent to those persons who are skilled in the railway coupling art, from the following more detailed description of the invention, particularly when such description is taken in conjunction with the attached drawing figures and with the appended claims.

BRIEF DESCRIPTION OF THE INVENTION

Figure 1:
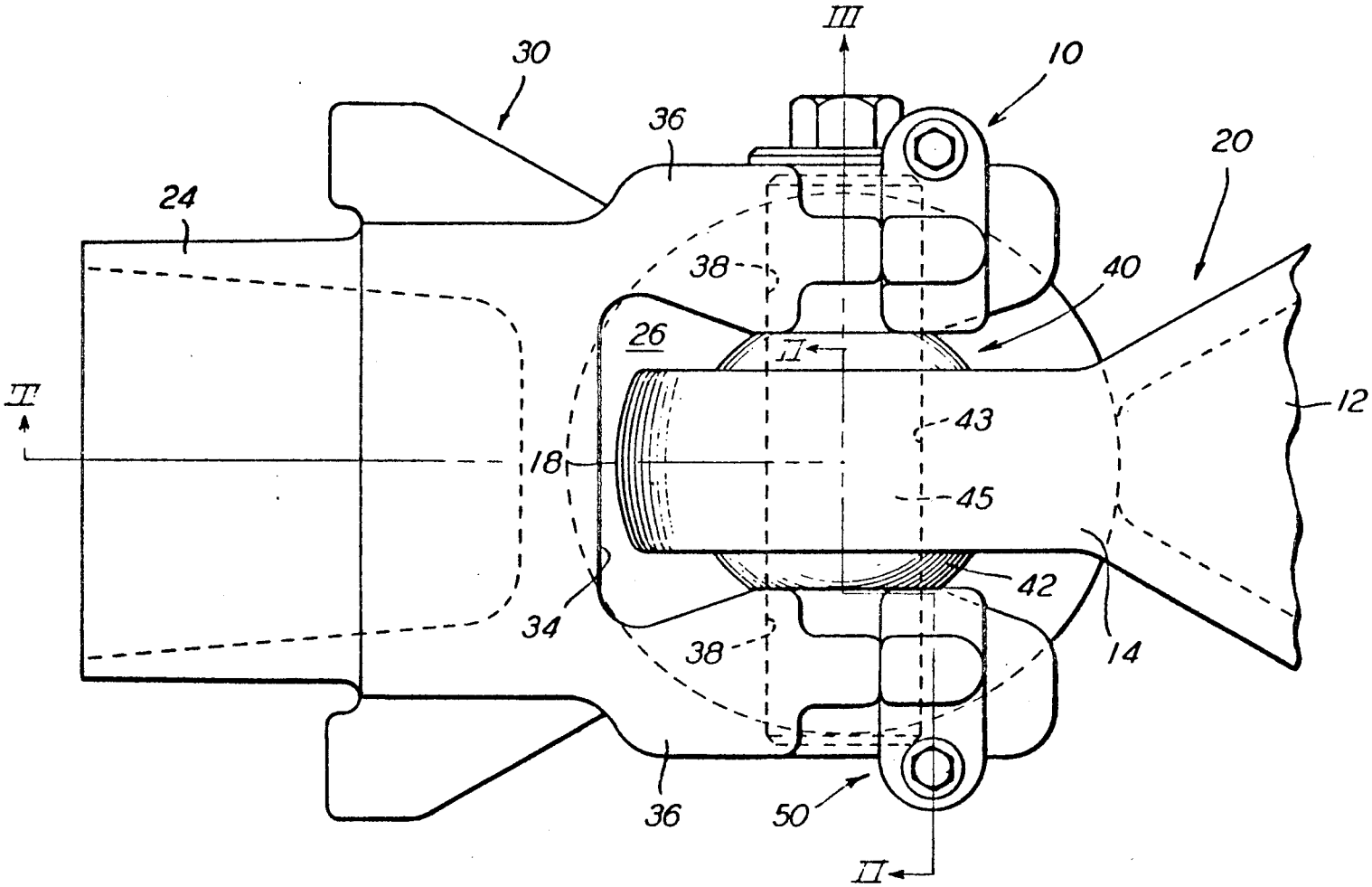
FIG. 1 is a top view, partially in cross-section, which illustrates one presently preferred embodiment of an articulable coupling apparatus constructed according to the present invention.

Prior to proceeding to the more detailed description of the instant invention, it should be noted that in each of the several views illustrated in the drawings identical components which have identical functions have been identified, for the sake of clarity, with identical reference numerals.

Figure 2:
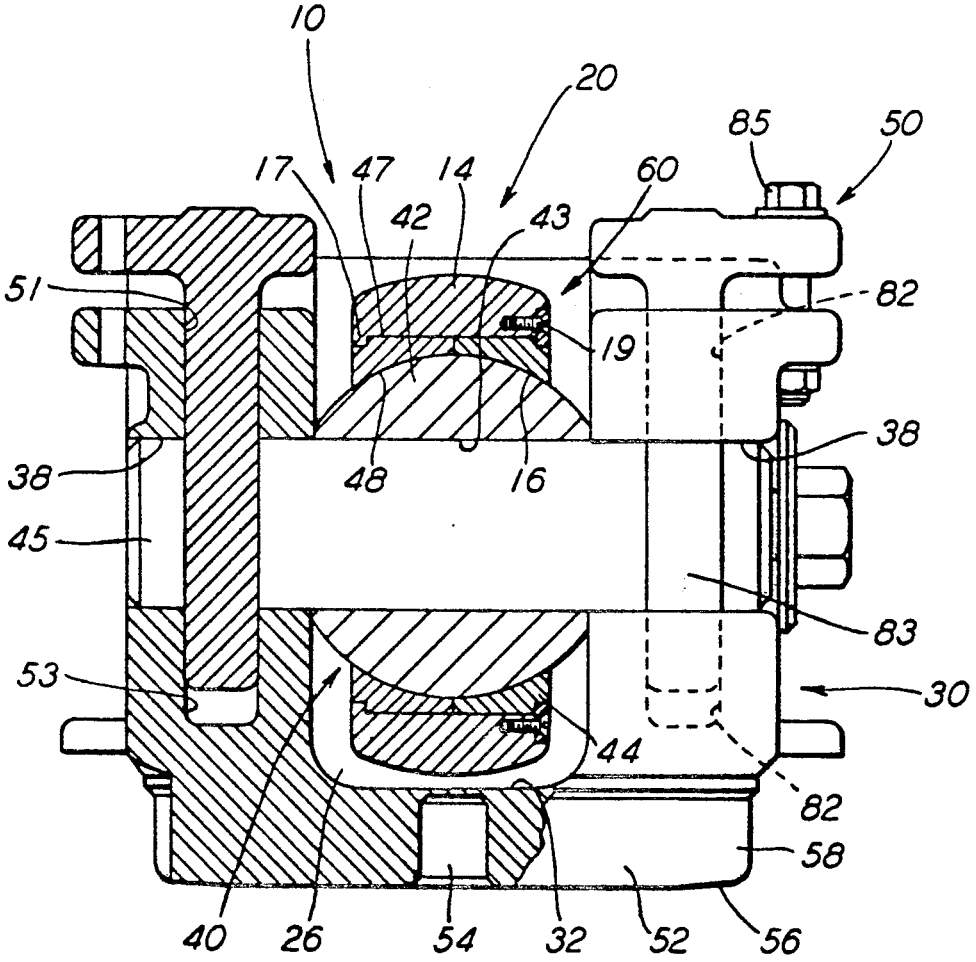
FIG. 2 is a view taken along lines II—II of FIG. 1 which illustrates an articulable coupling apparatus illustrated,,in FIG. 1; and FIG. a view taken along lines III—III of FIG. 1 which illustrates an articulable coupling apparatus constructed according to the present invention.
Figure 3:
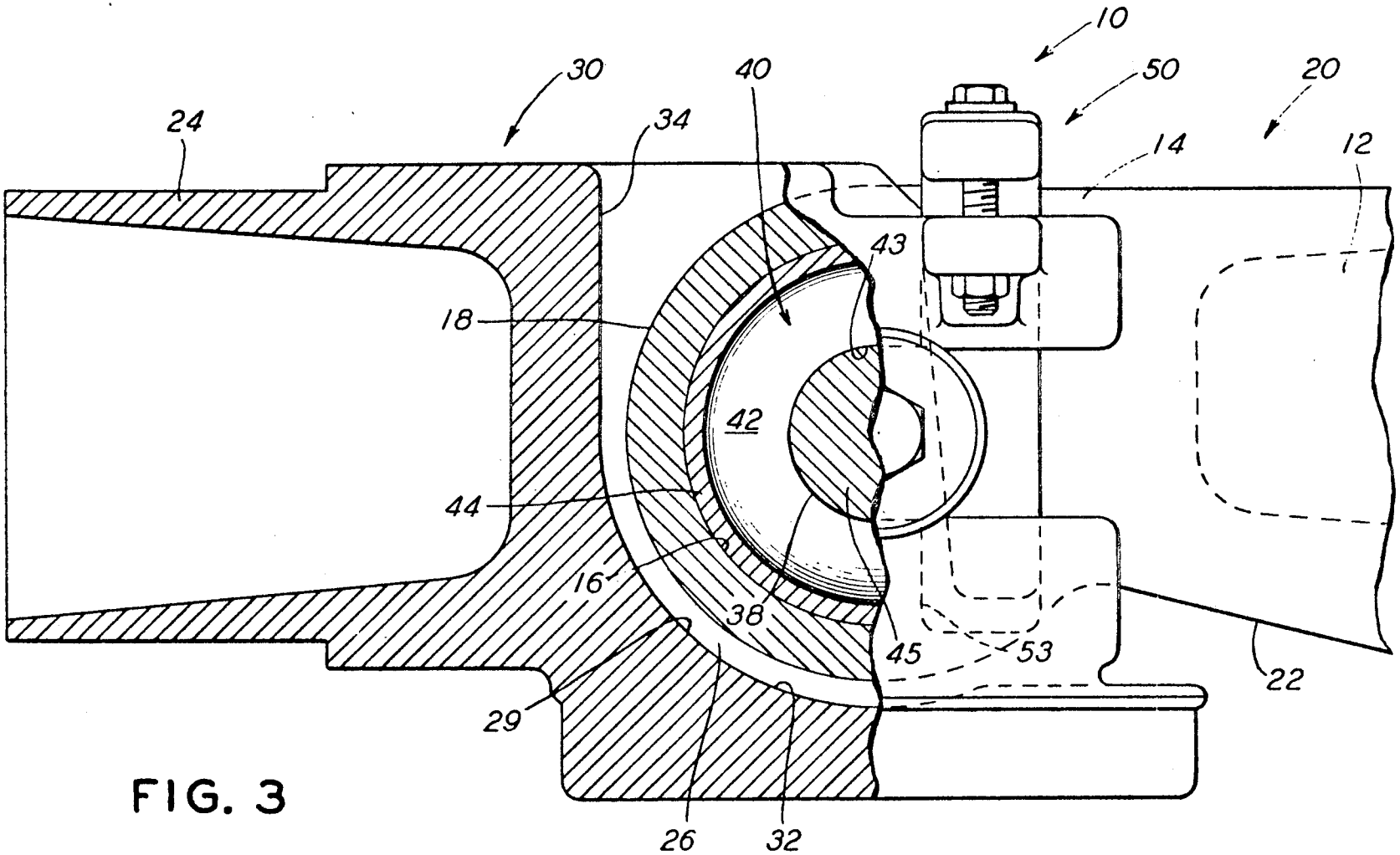

Now refer more particularly to FIGS. 1, 2 and 3 in which there is illustrated one presently preferred embodiment of an articulated coupling apparatus, generally designated 10, that is constructed in accordance with the principals of the present invention. This articulable-type coupling apparatus 10 can be retrofitted to existing railway cars, if desired, and is capable of connecting together, in a substantially semipermanent manner, at least one predetermined end of a first railway car (not shown) to an adjacent predetermined end of a second railway car (not shown).

Such articulated coupling apparatus 10 generally includes a male connection member, generally designated 20, a female connection member, generally designated 30, a bearing assembly, generally designated 40, and a means, generally designated 50, for securing the bearing assembly 40 to such articulated coupling apparatus 10 in a semipermanent fashion.

The male connection member 20 is adapted at a first end 12 thereof in a manner that will enable such male connection member 20 to be engaged with and connected to one predetermined end of a center sill member (not shown) disposed substantially along a longitudinal centerline of one of such first railway car and such second railway car.

Prior to being secured in place, preferably by welding, such first end 12 of the male connection member 20 is positioned within the center sill portion for a predetermined distance. Usually such predetermined distance will be about 6 to 10 inches, and about 8 inches being preferred and typical. Because such first end 12 of the male connection member 20 must fit within the center sill portion of the railway car, its outer dimensions are substantially controlled by the inner dimensions of such center sill portion. The second end 14 of such male connection member 20 is generally an elongated rectangular-shaped element. The outermost end 18 of such second end 14 of the male connection member 20 has a convex shape in a plane which extends in both a vertical direction and a horizontal direction. In addition, the bottom wall portion 22 of such second end 14 of the male connection member 20 is tapered upwardly, starting from a predetermined position and extending toward such first end 12. Such tapered portion has a taper of at least about 10 degrees. The purpose of this tapered portion of such bottom wall 22 of the male connection member 20 is to allow flexing in a horizontal plane when the cars are moving over hilly terrain.

Disposed within such second end 14 of the male connection member 20 is an aperture 16, the purpose of which will become clear as the description of the articulated coupling apparatus 10 proceeds. The aperture 16 includes a predetermined size and a predetermined shape. Such aperture 16 is formed through a predetermined portion of the second end 14 of such male connection member 20. This aperture 16 has a longitudinal axis that is disposed transverse to a longitudinal axis of such male connection member 20 and lies in a substantially horizontal plane. Such aperture 16 includes at least one ledge portion 17. In the presently preferred embodiment, a second ledge portion 19 is also provided. The purpose of such ledge portions 17 and 19 will become clear hereinafter.

The female connection member 30 includes a first end 24 which is configured in a manner that will enable such female connection member 30 to be engaged with and connected to an adjacent predetermined end of a center sill member (not shown) disposed substantially along a longitudinal centerline of an opposite one of such first railway car and such second railway car (not shown).

A cavity 26 is formed in a second end of the female connection member 30. This cavity 26 receives therein at least a portion of each of the second end 14 of such male connection member 20 and such aperture 16 formed through the predetermined portion of such second end 14 of the male connection member 20. This cavity 26 is formed by substantially horizontally-disposed bottom wall portion 32, a substantially vertically-disposed back wall portion 34 connected along a bottom edge thereof to a rear edge of such bottom wall portion 32, and a pair of vertically-disposed side wall portions 36 connected along a bottom edge thereof to the bottom wall portion 32 and along a rear edge thereof to such back wall portion 34. Such cavity 26 includes an arcuately-shaped portion 29 engageable with a predetermined portion of each of such bottom wall portion 32 and the back wall portion 34. A vertically-disposed plane which intersects a geometric centerline of each respective one of such pair of side wall portions 36 being substantially parallel to each other. An inner surface of each of such bottom wall portion 32 and such rear wall portion 34 and such pair of side wall portions 36 define a predetermined size and a predetermined shape of the cavity 26 which is open adjacent a top and front surface thereof.

An opening 38 is formed through a predetermined portion of each one of the pair of side wall portions 36. Each opening 38 at least includes a slot-like portion adjacent an end surface of a respective side wall portion 36. Such each opening 38 has a predetermined configuration.

The articulated coupling apparatus 10 includes a bearing assembly 40. Such bearing assembly 40 includes a substantially spherical member 42. At least a predetermined portion of such spherical member 42 is positioned within such aperture 16 formed through the predetermined portion of the second end 14 of the male connection member 20. Such spherical member 42 has a predetermined diameter.

A first bore 43 is formed through such spherical member 42. The first bore 43 has each of a predetermined size and a predetermined shape. A longitudinal axis of such first bore 43 lies in a substantially horizontal plane.

A pin member 45, which has a horizontally-disposed axis, is provided. Such pin member 45 extends through the first bore 43 in such spherical member 42 for a predetermined length on each side of axially-opposed surfaces of such spherical member 42. A portion of such pin member 45 is disposed within the first bore 43 of the spherical member 42 and has a substantially identical size and a substantially identical shape as the predetermined size and predetermined shape of such first bore 43. This enables such pin member 45 to be press-fit within the first bore 43. At least a portion of such predetermined length on each side of such spherical member 42, which engages at least a portion of such opening 38 formed through such pair of side wall portions 36, has a substantially identical size and identical configuration as such predetermined configuration of the opening 38.

A race assembly 44, having a substantially spherical inner surface positioned around such predetermined portion of the spherical member 42, is positioned within the aperture 16 to enable movement of such male connection member 20 in relation to such female connection member 30 in both a vertical direction and a horizontal direction over a predetermined range. Such race assembly 44 includes an outer surface which is substantially identical to such predetermined size and such predetermined shape of such aperture 16 formed through the predetermined portion of said second end 14 of the male connection member 20. At least one mating ledge surface 47 is provided on such race assembly 44 to matingly-engage such ledge 17 on such aperture 16.

A first securing means, generally designated 60, is engageable with each of such race assembly 44 and such second end 14 of said male connection member 20 for securing this race assembly 44 and the spherical member 42 to such second end 14 of said male connection member 20.

A second bore 51 is formed through at least one of such vertically-disposed side wall portions 36 adjacent a front edge 55 thereof and above such slot-like portion of such opening 38 formed through such side wall portion 36. Such second bore 51 has a substantially vertical axis.

A third bore 53 is formed through such at least one of such vertically-disposed side wall portion 36 adjacent such front edge 55 thereof and below such slot-like portion of such opening 38 formed through the side wall portion 36. The third bore 53 has a substantially vertical axis which is in axial alignment with the vertical axis of such second bore 51.

A second securing means, generally designated 50, is engageable with a portion of at least one of the predetermined lengths of such pin member 45 on such each side of the axially-opposed surfaces of such spherical member 42 and each of the second bore 51 and the third bore 53 formed in the at least one vertically-disposed side wall portion 36 for securing the bearing assembly 40 to the second end of the female connection member 30 and thereby securing such male connection member 20 to the female connection member 30 to form the articulable-type coupling apparatus 10 of the instant invention.

In one form of the invention, such substantially spherical inner surface of the race assembly 44 will have a substantially identical radius as the radius of such spherical member 42.

In the most preferred embodiment of the invention, however, such substantially spherical inner surface of such race assembly 44 will be slightly larger than the radius of such spherical member 42. In this case, such articulable-type coupling apparatus 10 further includes a lubricating liner 48 disposed intermediate such inner surface of the race assembly 44 and the spherical member 42.

It is presently preferred that such lubricating liner 48 will be formed in at least two pieces. It is also preferred that such lubricating liner be bonded to such inner surface of the race assembly 44. Such bonding of such lubricating liner 48 to such inner surface of the race assembly 44 preferably being accomplished by an adhesive material.

According to the present invention, the bottom wall portion 32 of such cavity 26, formed in the second end of such female connection member 30, further includes a center plate member 52 which matingly-engages a center bowl (not shown) of a bolster portion (not shown) of a railway car truck (not shown). Such center plate member 52 includes a vertically-disposed hole 54 adjacent a bottom surface 56 thereof. Such hole 54 is located substantially in the center of such center plate member 52.

Additionally, the articulable-type coupling apparatus 10 further includes a vertically-disposed pin member (not shown) which is engageable in such hole 54 in said center plate member 52 and a vertically-disposed hole (not shown) in such center bowl of such bolster.

It is presently preferred that the bottom surface 56 of such center plate member 52, which is a bearing surface, be hardened to at least about 375 Brinell for a depth of at least about one-eighth inch.

Further, such center plate member 52 is substantially round, and a vertically-disposed side 58 thereof is hardened to a Brinell hardness of at least about 300 for a distance of at least about one inch up from said bottom surface 56 and to a depth of about one-eighth inch.

In the presently preferred embodiment of this invention, the second end 14 of such male connection member 20 has a predetermined configuration adjacent an outermost end 18 thereof. This predetermined configuration of such outermost end 18 of said second end 14 of such male connection member 20 is a substantially convex shape in each of a vertically-disposed plane and a horizontally-disposed plane.

In addition, it is preferred that the vertically-disposed back wall portion 34 of such cavity 26 formed in said second end of such female connection member 30 has a predetermined configuration. This predetermined configuration of such vertically-disposed back wall portion 34 of said cavity 26 is a substantially concave shape in at least one of a vertical plane and a horizontal plane.

In this embodiment of the invention, it is also preferred that the predetermined shape of the aperture 16, formed through such predetermined portion of the second end 14 of such male connection member 20, is substantially round. Further, the ledge portion 17 extends inwardly from the aperture 16 while the ledge portion 47 on the race assembly 44 extends outwardly.

Furthermore, it is preferred that such race assembly 44 be formed in at least two pieces, which two pieces would be substantially identical.

The first securing means 60, engageable with each of such race assembly 44 and such second end 14 of the male connection member 20, can be a plate member 61 bolted to such second end 14 of such male connection member 20.

In the preferred embodiment of this invention, such pair of vertically-disposed side wall portions 36 include a tapered portion adjacent the front surface of such cavity 26 and adjacent such vertically-disposed back wall portion 34 of such cavity 26 to enable the second end 14 of such male connection member 20 to rotate about such spherical member 42 in a horizontal direction.

Additionally, the predetermined configuration of such opening 38, formed through such each pair of vertically-disposed side wall portions 36, at least includes a generally round portion engageable with a portion of a respective one of such predetermined length of such pin member 45.

While a number of embodiments of the articulated coupling apparatus, constructed according to the present invention, have been described in detail above, it should be obvious to persons skilled in the railway coupling art that various other modifications and adaptations of such articulated coupling apparatus can be made without departing from the spirit and scope of the appended claims.

We claim:

1. An articulable-type coupling apparatus which is capable of being retrofitted to an existing railway car and is capable of connecting together at least one predetermined end of a first railway car and an adjacent predetermined end of a second railway car in a substantially semipermanent manner, said articulable-type coupling apparatus comprising:

(a) a male connection member in which a first end thereof is configured in a manner that will enable said male connection member to be engaged with and connected to one predetermined end of a center sill member, such center sill member being disposed substantially along a longitudinal centerline of one of such first railway car and such second railway car;

(b) an aperture, having a predetermined size and a predetermined shape, formed through a predetermined portion of an elongated second end of said male connection member, said aperture includes at least one ledge portion and has a longitudinal axis that is disposed transverse to a longitudinal axis of said male connection member, said longitudinal axis of said aperture being in a substantially horizontal plane;

(c) a female connection member in which a first end thereof is configured in a manner that will enable said female connection member to be engaged with and connected to an adjacent predetermined end of a center sill member disposed substantially along a longitudinal centerline of an opposite one of such first railway car and such second railway car;

(d) a cavity formed in a second end of said female connection member which receives therein at least a portion of said second end of said male connection member and said aperture formed through said predetermined portion of said second end of said male connection member, said cavity having a substantially horizontally-disposed bottom wall portion, a substantially vertically-disposed back wall portion connected along a bottom edge thereof to a rear edge of said bottom wall portion, an arcuately-shaped portion engageable with a predetermined portion of each of said bottom wall portion and said back wall portion, and a pair of vertically-disposed side wall portions connected along a bottom edge thereof to said bottom wall portion and along a rear edge thereof to said back wall portion, a vertically-disposed plane which intersects a geometric centerline of each respective one of said pair of side wall portions being substantially parallel to each other, an inner surface of each of said bottom wall portion and said rear wall portion and said arcuately-shaped portion and said pair of side wall portions define a predetermined size and a predetermined shape of said cavity which is open adjacent a top and a front surface thereof;

(e) an opening formed through a predetermined portion of each of said pair of side wall portions, each opening at least includes a slot-like portion adjacent a front surface of a respective side wall portion, said each opening having a predetermined configuration;

(f) a bearing assembly, said bearing assembly includes:

(i) a substantially spherical member having a predetermined diameter, at least a portion of said spherical member being positioned within said aperture formed through said predetermined portion of said second end of said male connection member, (ii) a first bore formed through said spherical member, said bore having a predetermined size and a predetermined shape, (iii) a pin member, having a horizontally-disposed longitudinal axis, extending through said bore in said spherical member for a predetermined length on each side of axially-opposed surfaces of said spherical member, a portion of said pin member disposed within said bore of said spherical member has a substantially identical size and a substantially identical shape in said predetermined size and said predetermined shape of said bore, at least a portion of said predetermined length in said each side of said spherical member which engages at least a portion of said opening formed through said pair of side wall portions has a substantially identical size and identical configuration as said predetermined configuration of said opening, (iv) a race assembly having a substantially spherical inner surface positioned around said predetermined portion of said spherical member positioned within said aperture to enable movement of said male connection member in relation to said female connection member in both a vertical direction and a horizontal direction over a predetermined range, said race assembly having an outer surface which is substantially identical in size and shape as said predetermined size and said predetermined shape of said aperture formed through said predetermined portion of said second end of said male connection member, and (v) a first securing means engageable with each of said race assembly and said second end of said male connection member adjacent said aperture formed through said predetermined portion thereof for securing said race assembly and said spherical member to said second end of said male connection member;

(g) a second bore formed through at least one of said vertically disposed side walls adjacent a front edge thereof and above said slot-like portion of said opening formed through said side wall, said second bore having a substantially vertical axis;

(h) a third bore formed through said at least one of said vertically-disposed side walls adjacent said front edge thereof and below said slot-like portion of said opening formed through said side wall, said third bore having a substantially vertical axis which is in axial alignment with said vertical axis of said second bore; and (i) a second securing means engageable with a portion of at least one of said predetermined length of said pin member on said each side of said axially-opposed surfaces of said spherical member and each of said second bore and said third bore formed in said at least one vertically-disposed side wall for securing said male connection member to said female connection member to form said articulable-type coupling apparatus.

2. An articulable-type coupling apparatus, according to claim 1, wherein said substantially spherical inner surface of said race assembly has a substantially identical radius as a radius of said spherical member.

3. An articulable-type coupling apparatus, according to claim 1, wherein said substantially spherical inner surface of said race assembly is slightly larger than a radius of said spherical member, and said articulable-type coupling apparatus further includes a lubricating liner disposed intermediate said inner surface of said race assembly and said spherical member.

4. An articulable-type coupling apparatus, according to claim 3, wherein said lubricating liner is formed in at least two pieces.

5. An articulable-type coupling apparatus, according to claim 4, wherein said lubricating liner is bonded to said inner surface of said race assembly.

6. An articulable-type coupling apparatus, according to claim 5, wherein said lubricating liner is bonded to said inner surface of said race assembly by an adhesive.

7. An articulable-type coupling apparatus, according to claim 1, wherein said bottom wall portion of said cavity formed in said second end of said female connection member further includes a center plate member which matingly-engages a center bowl of a bolster portion of a railway car truck.

8. An articulable-type coupling apparatus, according to claim 7, wherein said center plate member includes a vertically-disposed hole adjacent a bottom surface thereof and substantially in a center thereof.

9. An articulable-type coupling apparatus, according to claim 8, wherein said articulable-type coupling apparatus further includes a vertically-disposed pin member engageable in said hole in said center plate member and a vertically-disposed hole in such center bowl of such bolster.

10. An articulable-type coupling apparatus, according to claim 9, wherein said bottom surface of said center plate member is a bearing surface which is hardened to at least about 375 Brinell for a depth of about one-eighth inch.

11. An articulable-type coupling apparatus, according to claim 10, wherein said center plate member is substantially round, and a vertically-disposed side thereof is hardened to a Brinell hardness of at least about 300 for a distance of about one inch up from said bottom surface and to a depth of about one-eighth inch.

12. An articulable-type coupling apparatus, according to claim 5, wherein said articulable-type coupling apparatus further includes:

(a) a center plate member which matingly-engages a center bowl of a bolster portion of a railway car truck formed on said bottom wall portion of said cavity at said second end of said female connection member, said center plate member is substantially round and a bottom surface thereof is a bearing surface which is hardened to a Brinell hardness of at least about 375 for a depth of about one-eighth inch, a vertically-disposed side of said center plate member is hardened to a Brinell hardness of at least about 300 for a distance of about one inch up from said bottom surface and to a depth of about one-eighth inch;

(b) a vertically-disposed hole formed substantially in a center of said center plate member adjacent said bottom surfaces thereof; and (c) a vertically-disposed pin member engageable in said hole in said center plate member and a vertically-disposed hole in such center bowl of such bolster.

13. An articulable-type coupling apparatus, according to claim 1, wherein said second end of said male connection member has a predetermined configuration adjacent an outermost end thereof.

14. An articulable-type coupling apparatus, according to claim 13, wherein said predetermined configuration of said outermost end of said second end of said male connection member is a substantially convex shape in each of a vertically-disposed plane and a horizontally-disposed plane.

15. An articulable-type coupling apparatus, according to claim 5, wherein said second end of said male connection member has a substantially convex shape in each of a vertically-disposed plane and a horizontally-disposed plane adjacent an outermost end thereof.

16. An articulable-type coupling apparatus, according to claim 9, wherein said second end of said male connection member has a substantially convex shape in each of a vertically-disposed plane and a horizontally-disposed plane adjacent an outermost end thereof.

17. An articulable-type coupling apparatus, according to claim 11, wherein said second end of said male connection member has a substantially convex shape in each of a vertically-disposed plane and a horizontally-disposed plane adjacent an outermost end thereof.

18. An articulable-type coupling apparatus, according to claim 12, wherein said second end of said male connection member has a substantially convex shape in each of a vertically-disposed plane and a horizontally-disposed plane adjacent an outermost end thereof.

19. An articulable-type coupling apparatus, according to claim 14, wherein said vertically-disposed back wall portion of said cavity formed in said second end of said female connection member has a predetermined configuration.

20. An articulable-type coupling apparatus, according to claim 19, wherein said predetermined configuration of said vertically-disposed back wall portion of said cavity is a substantially concave shape in at least one of a vertical plane and a horizontal plane.

21. An articulable-type coupling apparatus, according to claim 20, wherein said predetermined configuration of said vertically-disposed back wall portion of said cavity is a substantially concave shape in each of a vertical plane and a horizontal plane.

22. An articulable-type coupling apparatus, according to claim 18, wherein said vertically-disposed back wall portion of said cavity formed in said second end of said female connection member has a substantially concave shape in at least one of a vertical plane and a horizontal plane.

23. An articulable-type coupling apparatus, according to claim 1, wherein said predetermined shape of said aperture formed through said predetermined portion of said second end of said male connection member is substantially round.

24. An articulable-type coupling apparatus, according to claim 23, wherein said aperture formed through said predetermined portion of said second end of said male connection member includes at least one inwardly-extending ledge portion adjacent at least one predetermined outer surface thereof.

25. An articulable-type coupling apparatus, according to claim 5, wherein said predetermined shape of said aperture formed through said predetermined portion of said second end of said male connection member is substantially round, and said aperture includes at least one inwardly-extending ledge portion adjacent at least one predetermined outer surface thereof.

26. An articulable-type coupling apparatus, according to claim 12, wherein said predetermined shape of said aperture formed through said predetermined portion of said second end of said male connection member is substantially round, and said aperture includes at least one inwardly-extending ledge portion adjacent at least one predetermined outer surface thereof.

27. An articulable-type coupling apparatus, according to claim 18, wherein said predetermined shape of said aperture formed through said predetermined portion of said second end of said male connection member is substantially round, and said aperture includes at least one inwardly-extending ledge portion adjacent at least one predetermined outer surface thereof.

28. An articulable-type coupling apparatus, according to claim 22, wherein said predetermined shape of said aperture formed through said predetermined portion of said second end of said male connection member is substantially round, and said aperture includes at least one inwardly-extending ledge portion adjacent at least one predetermined outer surface thereof.

29. An articulable-type coupling apparatus, according to claim 24, wherein said race assembly includes at least one complimentary ledge portion which abuttingly-engages said at least one ledge portion adjacent said at least one predetermined outer surface of said aperture formed through said predetermined portion of said second end of said male connection member.

30. An articulable-type coupling apparatus, according to claim 28, wherein said race assembly includes at least one complimentary ledge portion which abuttingly-engages said at least one ledge portion adjacent said at least one predetermined outer surface of said aperture formed through said predetermined portion of said second end of said male connection member.

31. An articulable-type coupling apparatus, according to claim 1, wherein said race assembly is formed in at least two pieces.

32. An articulable-type coupling apparatus, according to claim 31, wherein said at least two pieces forming said race assembly are substantially identical.

33. An articulable-type coupling apparatus, according to claim 29, wherein said race assembly is formed in at least two substantially identical pieces.

34. An articulable-type coupling apparatus, according to claim 1, wherein said aperture in said second end of said male connection member and said race assembly each include two ledge portions.

35. An articulable-type coupling apparatus, according to claim 5, wherein said aperture in said second end of said male connection member and said race assembly each include two ledge portions.

36. An articulable-type coupling apparatus, according to claim 12, wherein said aperture in said second end of said male connection member and said race assembly each include two ledge portions.

37. An articulable-type coupling apparatus, according to claim 18, wherein said aperture in said second end of said male connection member and said race assembly each include two ledge portions.

38. An articulable-type coupling apparatus, according to claim 28, wherein said aperture in said second end of said male connection member and said race assembly each include two ledge portions.

39. An articulable-type coupling apparatus, according to claim 1, wherein said first securing means engageable with said each of said race assembly and s aid second end of said male connection member is a circular plate member.

40. An articulable-type coupling apparatus, according to claim 29, wherein said first securing means engageable with said each of said race assembly and said second end of said male connection member is a circular plate member.

41. An articulable-type coupling apparatus, according to claim 1, wherein each of said pair of vertically-disposed side wall portions includes a tapered portion adjacent said front surface of said cavity and adjacent said vertically-disposed back wall portion of said cavity to enable said second end of said male connection member to rotate about said spherical member in a horizontal direction.

42. An articulable-type coupling apparatus, according to claim 5, wherein each of said pair of vertically-disposed side wall portions includes a tapered portion adjacent said front surface of said cavity and adjacent said vertically-disposed back wall portion of said cavity to enable said second end of said male connection member to rotate about said spherical member in a horizontal direction.

43. An articulable-type coupling apparatus, according to claim 12, wherein each of said pair of vertically-disposed side wall portions includes a tapered portion adjacent said front surface of said cavity and adjacent said vertically-disposed back wall portion of said cavity to enable said second end of said male connection member to rotate about said spherical member in a horizontal direction.

44. An articulable-type coupling apparatus, according to claim 18, wherein each of said pair of vertically-disposed side wall portions includes a tapered portion adjacent said front surface of said cavity and adjacent said vertically-disposed back wall portion of said cavity to enable said second end of said male connection member to rotate about said spherical member in a horizontal direction.

45. An articulable-type coupling apparatus, according to claim 29, wherein each of said pair of vertically-disposed side wall portions includes a tapered portion adjacent said front surface of said cavity and adjacent said vertically-disposed back wall portion of said cavity to enable said second end of said male connection member to rotate about said spherical member in a horizontal direction.

46. An articulable-type coupling apparatus, according to claim 1, wherein said predetermined configuration of said opening formed through said each opening in said pair of vertically-disposed side wall portions at least includes a generally round portion engageable with a portion of a respective one of said pair of shaft members.

* * * * *